United States Patent [19]

Kunczynski

[11] Patent Number: 4,848,241

[45] Date of Patent: Jul. 18, 1989

[54] AERIAL TRAMWAY SYSTEM AND METHOD HAVING PARALLEL HAUL ROPES

[75] Inventor: Jan K. Kunczynski, Glenbrook, Nev.

[73] Assignees: Zygmunt Alexander Kunczynski; Alexander Jan Kunczynski, both of Carson City, Nev.

[21] Appl. No.: 157,588

[22] Filed: Feb. 19, 1988

Related U.S. Application Data

[63] Continuation-in-part of Ser. No. 31,927, Mar. 30, 1987, abandoned.

[51] Int. Cl.[4] ..... B61B 7/00

[52] U.S. Cl. ..... 104/173.1; 474/51

[58] Field of Search ..... 104/173.1, 173.2, 180, 104/192, 208; 474/49–57

[56] References Cited

U.S. PATENT DOCUMENTS

| | | | |
|---|---|---|---|
| 3,087,349 | 4/1963 | Herting | 474/51 |
| 4,509,430 | 4/1985 | Creissels | 104/173.1 |

FOREIGN PATENT DOCUMENTS

| | | |
|---|---|---|
| 1249949 | 11/1959 | France . |
| 2430901 | 7/1978 | France . |
| 2448464 | 2/1979 | France . |
| 2504480 | 4/1981 | France . |
| 2525981 | 4/1982 | France . |

*Primary Examiner*—Joseph F. Peters, Jr.
*Assistant Examiner*—Jesûs D. Sotelo
*Attorney, Agent, or Firm*—Flehr, Hohbach, Test, Albritton & Herbert

[57] ABSTRACT

An aerial tramway system and method are disclosed in which pairs of haul ropes are mounted to vertically oriented bull wheels. The drive bull wheels are preferably mounted to a common drive shaft to help synchronize haul rope advancement. An adjustment assembly is provided on one of the pair of drive bull wheels to enable dynamic adjustment of the effective radius of the bull wheel without changing the bull wheel rotation rate. Adjustment is based upon sensor feedback to previsely synchronize the haul rope advancement. The aerial tramway system further includes a first pair of endless loop haul ropes operating in one direction and a second pair of endless loop haul ropes operating in an opposite direction. The passenger carrier units are demountably attached to the haul ropes and transferred along transfer paths between stations at the end of the haul ropes so as to provide a system in which the passenger carrier units can be continuously cycled around the loop formed by the two pairs of haul ropes. An adjustable bull wheel assembly and method of employing the same to maintain haul rope synchronism are also disclosed.

20 Claims, 4 Drawing Sheets

AERIAL TRAMWAY SYSTEM AND METHOD HAVING PARALLEL HAUL ROPES

RELATED APPLICATION

This application is a continuation-in-part application based upon co-pending application Ser. No. 31,927 filed Mar. 30, 1987, now abandoned, Aerial Tramway System and Method Having Parallel Haul Ropes and Vertical Bull Wheels.

TECHNICAL FIELD

The present invention relates generally to the field of aerial tramways, and more particularly, relates to aerial tramways in which the passenger carriers are mounted between a pair of haul ropes driven by bull wheels rotating in a vertical plane.

BACKGROUND ART

Most aerial tramway systems which are currently in use employ a haul rope which is an endless loop that is driven at one end by a drive bull wheel rotating in a horizontal plane. The opposite end of the haul rope loop also is supported on a horizontally oriented idler bull wheel. Intermediate sheaves, usually positioned on towers, support the haul rope and passenger carrier units as they move along the loop. Usually there is a station at each end proximate the bull wheels, and the passenger carrier units may be permanently affixed to the haul rope or demountably attached to the haul rope.

One problem which has been encountered in connection with aerial tramway systems which employ a single endless cable or haul rope is that the passenger carrier unit can swing laterally with respect to the haul rope as a result of wind loading and/or movement of the passengers in the unit. To lessen this tendency, a variety of hanger arms have been devised which will damp or resist lateral motion of the passenger carrier unit.

Another problem which has been encountered in connection with single rope aerial tramway systems has been that, as the steepness of the course increases, the hanger arm on which the cabin, gondola or chair is supported must also increase in length. As the steepness of the aerial tramway course increases, there is a tendency for the downhill end of the passenger carrier unit to engage the haul rope, since the passenger carrier unit must be mounted directly beneath the haul rope in single rope systems. This problem is increased by the necessity of mounting the passenger carrier unit to the haul rope in a manner which will permit some fore-and-aft swinging of the unit.

As the length of the cabin or gondola hanger arm increases to accommodate steepness in the tramway course, the potential for fore-and-aft swinging also increases, since the wind load on the cabin acts on a longer and longer moment arm. Similarly, the increased length in the hanger arm also increases the tendency for lateral swinging under dynamic loading because of the increased moment arm.

One approach which has been tried to reduce the lateral swing of the passenger carrier units in an aerial tramway system is to mount the cabins between a pair of haul ropes. Thus, lateral stability can be achieved if the passenger carrier unit grips a pair of side-by-side haul ropes which are simultaneously advanced in synchronism in the same direction. Such pairs of haul ropes have been mounted to both vertically and horizontally oriented, bull wheels. Typical of such a vertical bull wheel system is the aerial tramway assembly of French Patent Application published on May 9, 1980 as publication No. 2,448,464 and corresponding U.S. Pat. No. 4,509,430. In this aerial tramway four parallel, endless-loop haul ropes are mounted to four parallel, vertically oriented bull wheels. The passenger carrier unit is coupled to all four haul ropes by four grip assemblies, which provide the passenger carrier unit with extremely high stability against lateral swinging. The system, however, is relatively complex and inherently produces a new problem.

Any aerial tramway system in which the passenger carrier units are simultaneously coupled to more than one haul rope raises the problem of synchronizing the movement of the haul ropes. Even if the driving bull wheels are mounted to a common drive shaft, it is virtually certain that the ropes will not be advanced at precisely the same rate. For example, for a typical aerial tramway systems a bull wheel may have a diameter of about 10 feet. If two bull wheels are manufactured with an error in tolerances of only 0.02 inches on the diameter, these two bull wheels will produce a difference in the haul rope position of approximately 6.28 inches after only 100 revolutions. Similarly, differences in friction of the haul rope on the support sheaves under varying loads can produce errors in synchronism as larger or larger than bull wheel diameter differences.

It is very difficult to determine the speed of the haul rope except through inferential measurements. Thus, the tramway of U.S. Pat. No. 4,509,430, for example, to synchronizes the movement of parallel haul ropes based upon torque sensing, i.e., drive motor voltage and the use of an electric differential. The problem with this approach is that friction of the support sheaves on the rope may vary substantially and produce false torque sensing that result in erroneous and constant adjustments of the bull wheel drive torque.

Additionally, the system of U.S. Pat. No. 4,509,430 also employs relatively rigid coupling bars between adjacent haul ropes and the haul ropes are mounted close together to attempt to minimize differences or force synchronization. Mounting the haul ropes close together, however, reduces laeral cabin stability and requires a long hanger arm when used on steep slopes.

Another approach to the lateral stabilization of passenger carrier units on an aerial tramway is disclosed in French Patent Application Publication No. 2,525,981. In this patent two horizontally oriented bull wheels are used to provide the parallel haul ropes. This system is again faced with the problem of haul rope synchronization, which is made even more diffcult by the fact that the use of horizontal bull wheels results in cable paths which are not of the same length. Thus, the bull wheels cannot be operated conveniently off the same drive shaft.

A similar approach employing a single common bull wheel is set forth in French Patent No. 1,249,949. Thus, the system employs a bull wheel having two cable receiving grooves, but the problems of tolerances in manufacture still remain the same, namely, very small errors in the groove diameters can induce intolerable differences in the position of the two haul ropes.

It should be noted that even if both grooves, or both bull wheels, are manufactured to exactly the same tolerances, the rubber groove linings that are engaged by the haul rope cannot be assumed to deflect absolutely uniformly. Thus, even perfectly manufactured bull wheels will introduce differences in the position of the haul ropes which are driven as a result of uneven compression of the groove lining material.

Still a further aerial tramway system is disclosed in French Patent Application Publication No. 2,430,901 in which vertical bull wheels are used to drive parallel haul ropes. Permanently mounted between the haul ropes are conveyor buckets or tubs which simply pass around the vertical bull wheels and return in an inverted position. The problem of rope synchronization still exists, and since the units are permanently affixed to the haul ropes, the accumulative error can be quite substantial unless some provision is made to adjust the lack of synchronism between the haul ropes.

Accordingly, it is an object of the present invention to provide an aerial tramway system and method which affords the stability advantages of coupling of the passenger carrier units to side-by-side haul ropes while maintaining the synchronous operation of the haul ropes.

It is another object of the present invention to provide an aerial tramway system and method in which lateral swinging and fore-and-aft swinging of the carrier units are minimized.

It is another object of the present invention to provide an aerial tramway system and method in which multiple drive bull wheels can be operated from a common drive shaft while still maintaining synchronism in the displacement of the haul ropes driven by the bull wheels.

Still a further object of the present invention is to provide an aerial tramway system and method in which the passenger carrier units can be easily mounted to and demounted from the tramway haul ropes.

Still a further object of the present invention is to provide a bull wheel assembly for an aerial tramway which enables dynamic adjustment of the rate at which the haul rope is driven without changing the rate of rotation of the bull wheel to enable synchronization of the speed of advancement of the haul rope as compared to a parallel rope operating at the same speed.

Still a further object of the present invention is to provide an aerial tramway and adjustable bull wheel assembly which has enhanced safety, is easy to operate, is durable, and requires minimum maintenance.

DISCLOSURE OF INVENTION

The aerial tramway assembly of the present invention includes at least one bull wheel mounted for rotation, and a haul rope mounted on and extending around a portion of the bull wheel. The haul rope extends away from the bull wheel to haul rope support assembly. The improvement in the tramway system is comprised, briefly, of an assembly for varying the effective radius of the bull wheel to change the rate of advancement of the haul rope without changing the rate of rotation of the bull wheel. Additionally, the aerial tramway system preferably is formed with a pair of side-by-side bull wheels oriented in a substantially vertical plane with a pair of haul ropes mounted to the pair of bull wheels. One of the two bull wheels includes the radius adjustment assembly. Sensors provide feedback to the adjustment assembly as to the position of carrier unit grips which grip the parallel haul ropes so as to adjust the rate of rope advancement to prevent skewing of the grips and passenger carrier units between the ropes. The tramway system also preferably includes two courses, an uphill and a downhill course, with transfer structures extending between the two courses at opposite ends thereof to enable detachment of passenger carrier units from one pair of haul ropes, transfer along the transfer structures or paths to the second pair of haul ropes and attachment of the passenger carrier units to the second pair of haul ropes.

The method of changing the rate of advancement of a haul rope, and particularly the method of maintaining synchronism between a pair of haul ropes advancing in parallel relation in the same direction is comprised, briefly, of varying the radius of the bull wheel on which the haul ropes are mounted during operation of the bull wheel. Feedback from grip sensing apparatus may be used to vary the bull wheel radius to change the speed of advancement of the haul rope.

BEST MODE FOR CARRYING OUT THE INVENTION

Figure 1:
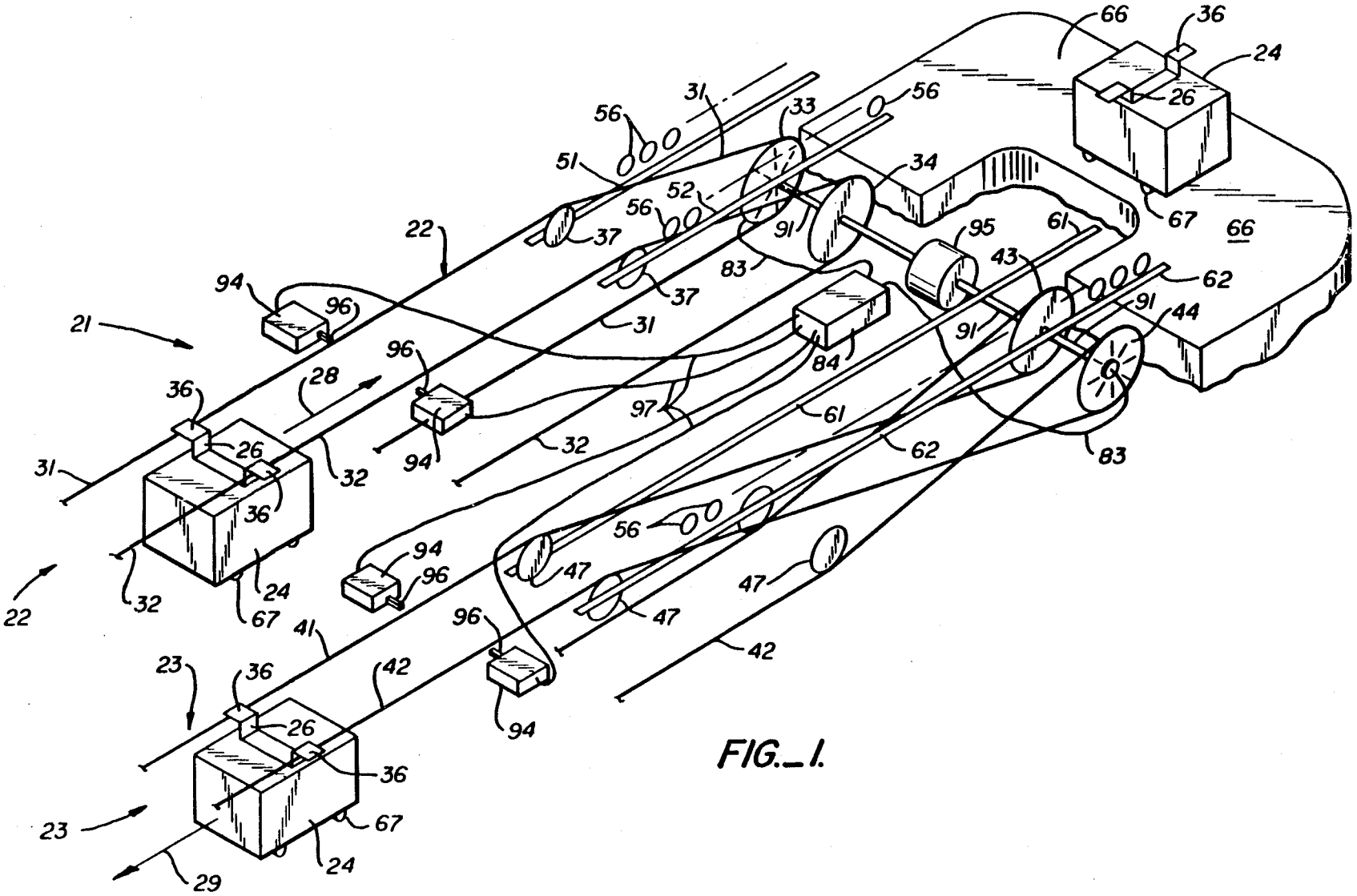
FIG. 1 is a top perspective view of a schematic representation of an upper station area of an aerial tramway system constructed in accordance with the present invention.

Aerial tramway system 21 of the present invention as illustrated in FIG. 1 includes two dual haul rope assemblies 22 and 23. Assembly 22 conveys passenger carrier units 24 along a first course which extends in an uphill direction (as indicated by arrow 28), while haul rope assembly 23 conveys passenger units 24 along a second course which extends in a downhill direction (as indicated by arrow 29). As will be appreciated, some aerial tramways extend over horizontal courses, in which case dual haul rope assembly 22 merely conveys units in one direction, while dual haul rope assembly 23 conveys units 24 in an opposite direction.

Figure 3:
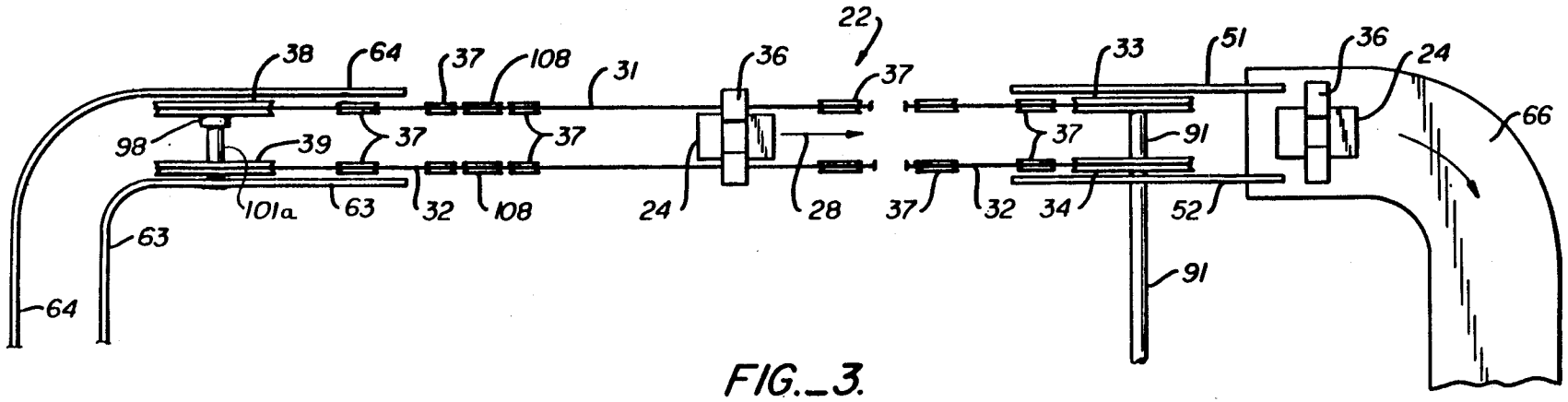
FIG. 3 is a top plan view of the uphill haul ropes of FIG. 2.

In order to enhance the stabilization of the passenger carrier units 24 and to facilitate attachment and detachment of the passenger cabins, aerial tramway system 21 employs pairs of haul ropes mounted to vertical bull wheels. Thus, uphill haul rope assembly 22 includes a first pair of haul ropes 31 and 32 which are mounted between a first pair of drive bull wheels 33 and 34 and a first pair of idler bull wheels 38 and 39 (FIG. 3). All of the bull wheels are preferably oriented in a generally vertical plane. Support means for the outward bound and return sides of haul ropes 31 and 32, in the form of sheaves 37, are provided along the first course. Such support sheaves are usually mounted to support towers (not shown). Passenger carrier unit 24 is coupled between first haul ropes 31 and 32 by grip assemblies 36 formed to enable attachment to and detachment of the passenger carrier unit from the haul ropes.

Figure 4:
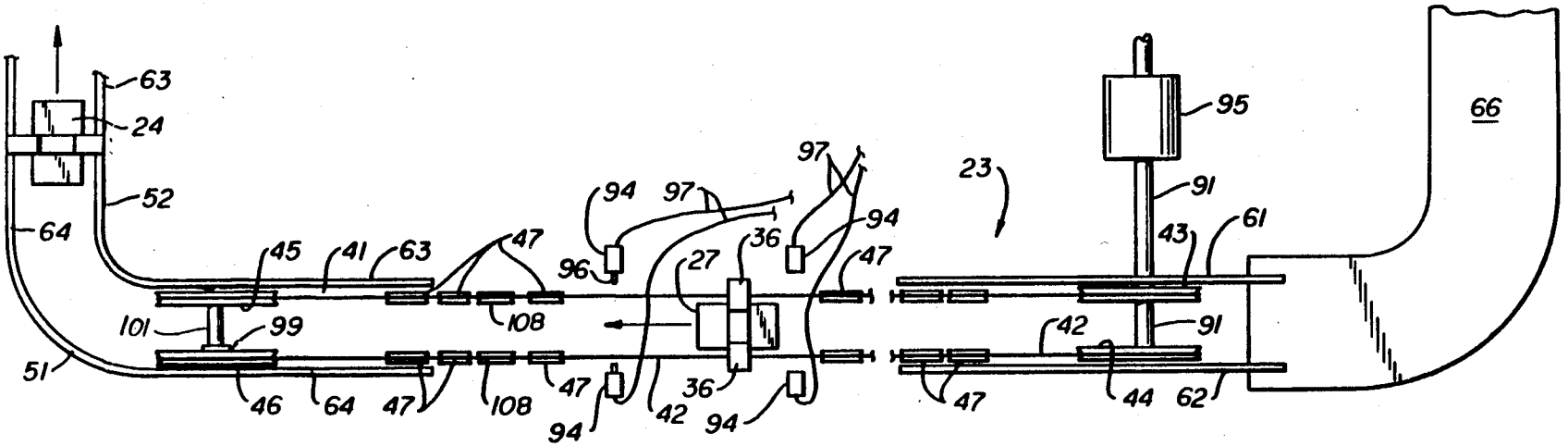
FIG. 4 is a top plan view corresponding to FIG. 3 of the downhill pair of haul ropes of the tramway system of FIG. 1.

Haul rope assembly 23 similarly includes a second pair of haul ropes 41 and 42 which are mounted to a second pair of drive bull wheels 43 and 44 and idler bull wheels 45 and 46 (FIG. 4). Bull wheels 41–46 also are oriented in a substantially vertical plane, and ropes 41 and 42 are supported for movement on support sheaves 47. Again, passenger carrier unit 24 is demountably attached to haul ropes 41 and 42 by grip assemblies 36.

A grip which is particularly well suited for use in the aerial tramway system of the present invention is disclosed in my co-pending U.S. application Ser. No. 766,710 entitled AERIAL TRAMWAY GRIP ASSEMBLY AND METHOD. Numerous detachable grip assemblies are known for use with aerial tramways, and the particular structure grip assembly 36 is not regarded as a novel portion of the present invention.

Figure 2:
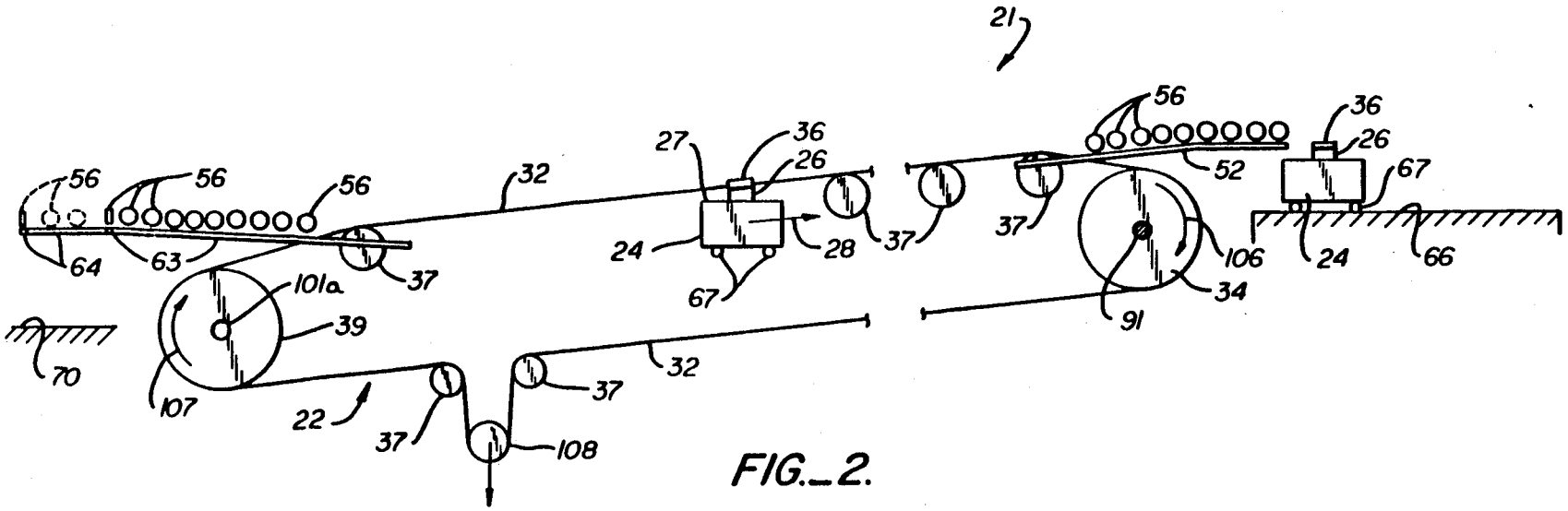
FIG. 2 is a schematic, side elevational view of the uphill pair of the aerial tramway haul ropes in the system of FIG. 1.

Attachment and detachment of carrier units 24 to the haul ropes similarly is preferably accomplished in a conventional manner. Thus, grip assembly 36 may be opened by a grip opening assembly (not shown) and the passenger carrier unit supported on a support surface while at least one of the carrier unit and the haul rope are separated. As shown in the drawing, a pair of rails 51 and 52 are positioned proximate first ropes 31 and 32. The grip assemblies 36 further preferably include rail engaging rollers (not shown) which will support unit 24 from rails 51 and 52. As will be seen in FIG. 2, haul ropes 31 and 32 drop away from rails 51 and 52 between the last support sheaves 37 and the first drive bull wheels 33 and 34. Additionally, rails 51 and 52 can be upwardly inclined slightly (best seen in FIG. 2) to effect gravity deceleration of the passenger carrier units after they are detached from the haul rope.

In order to better control the rate of discharge of the tramway cabins from rails 51 and 52, a plurality of drive wheels 56, which frictionally engage the top of grip assembly 36, are positioned above the support rails. These drive wheels are controlled by a central controller and regulate the rate of advancement of the detached carrier unit on rails 51 and 52. Conveyor drive wheels 56 are not shown in FIG. 3 for the sake of clarity of illustration. This type of conveyor system is described in detail in my U.S. Pat. application Ser. No. 722,697, and will not be repeated herein. There are numerous rail-based techniques for conveying detached tramway passenger carrier units on path defining means such as rails 51 and 52. See, e.g., French Patent No. 2,504,480. In the aerial tramway system illustrated in the drawing, the uphill end or station of tramway system 21 includes a transfer platform 66 that extends between the upper end of the first pair of haul ropes and the upper end of the second pair of haul ropes. Carrier units 24 preferably include wheel assemblies 67 which allow the carrier units to be movably supported on platform 66 when they are discharged from rails 51 and 52 by drive Wheels 56 onto the platform. If desired, platform 66 can include guide means (for example, grooves, tracks or rails) for guiding the motion along the platform, as well as drive means for urging the detached carrier units from first haul rope assembly 22 to second haul rope assembly 23. The passenger carrier units can be unloaded on platform 66, transferred from one haul rope pair to the other and loaded with passengers proximate second haul rope pair 23. In their unloaded state, transfer of cabins 24 manually by lift operators along platform 66 can be easily accomplished.

Once cabins 24 reach second or downhill haul rope assembly 23, the cabins may be attached to second pair of haul ropes 41 and 42 by urging the cabins onto acceleration rails 61 and 62. Again, drive wheels 56 are preferably provided above rails 61 and 62 to control acceleration of the cabins up to the speed of the haul rope. Attachment means (not shown) closes grip assemblies around haul ropes 41 and 42 simultaneous, and the cabins are conveyed to the downhill end or station of the tramway.

At the downhill end of tramway 21, a pair of deceleration rails 63 and 64 are provided with associated drive wheels 56. At the lower end of the tramway rails 63 and 64 extend from the second pair of ropes 41 and 42 to the first pair of ropes 31 and 32 so that wheels 67 of the cabin are always above the station platform 70.

As will be apparent either form of transfer path, a platform or rails, can be used at either end of the tramway.

Figure 5:
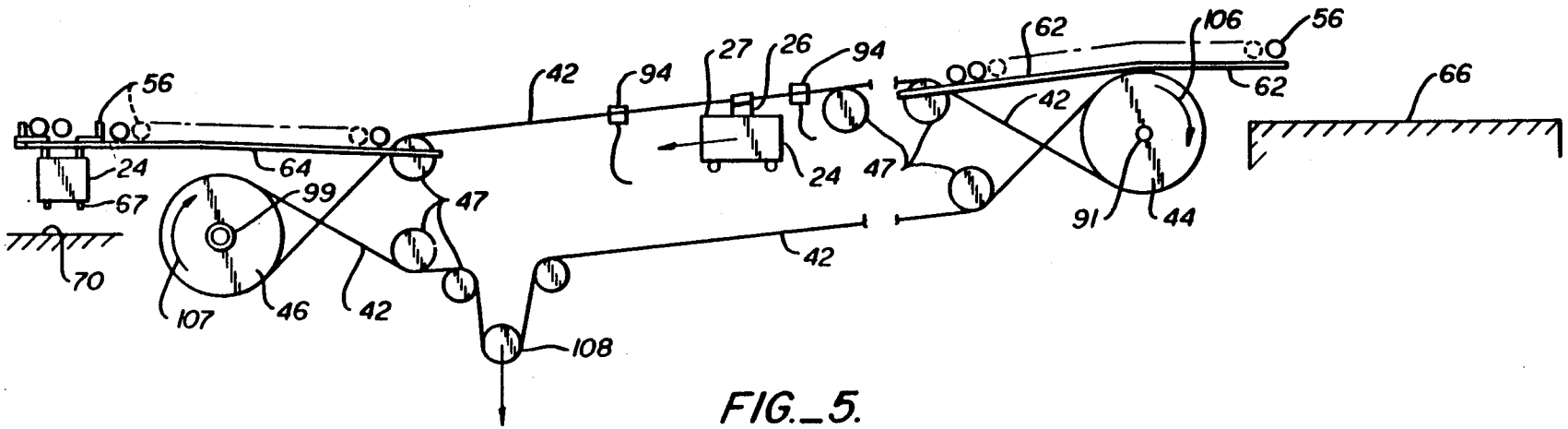
FIG. 5 is a schematic, side elevational view of the downhill haul ropes of FIG. 4.

As best may be seen in FIGS. 3 and 4, passenger carrier units 24 preferably have a width dimension less than the lateral separation between the dual haul ropes in each assembly. This construction enables the hanger arms 26 from the grip assemblies 36 to be relatively short, even for steep aerial tramway courses. As can be seen from FIGS. 2 and 5, the downhill end 27 of the passenger carrier unit 24 comes closest to the haul rope as the steepness of the course increases. Since the body of carrier units 24 has a width dimension less than the width between the haul ropes, however, the downhill end 27 will merely pass up between the haul ropes in the tramway system of the present invention.

The use of dual haul ropes, therefore, greatly enhances the lateral stability of the passenger carrier unit, and the formation of the cabin of the carrier unit with a width dimension less than the width between the haul ropes enables a relatively short hanger arm 26 to be employed. The shorter hanger arm enhances stability in the fore-and-aft direction, and further enhances the lateral stability by reducing the moment arm between the grip and the center of pressure of the tramway cabin. Such an increase in cabin stability enables a greater separation of intermediate support towers along the length of the tramway course. Thus, towers separated by as much as 1500 to 2000 feet are possible in some installations.

It is a further and important feature of the aerial tramway system of the present invention that the tramway haul ropes are advanced at a rate which can be adjusted to maintain synchronism. The pairs of haul ropes must advance at the same rate so that the grips and carrier cabins do not become skewed as a result of uneven advancement.

Figure 7:
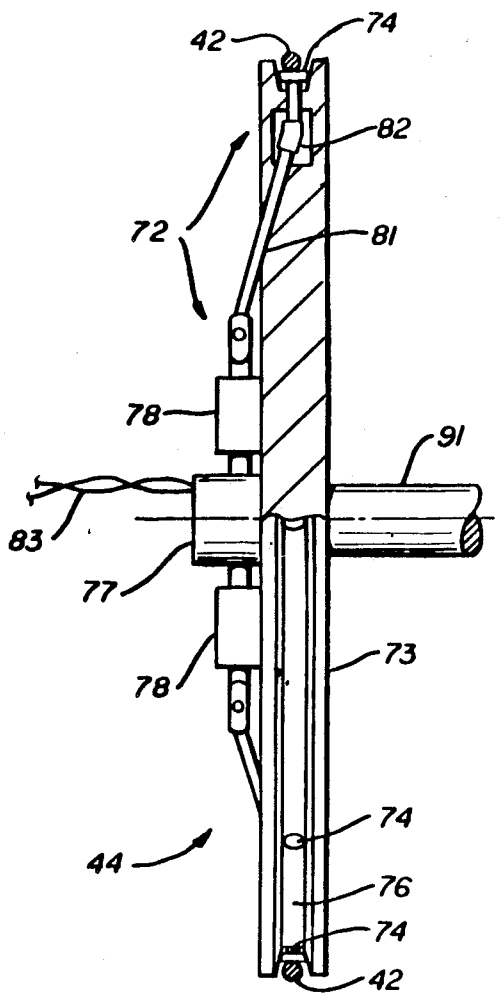
FIG. 7 is an end elevation view, partially in cross-section, of the bull wheel assembly of FIG. 6.
Figure 6:
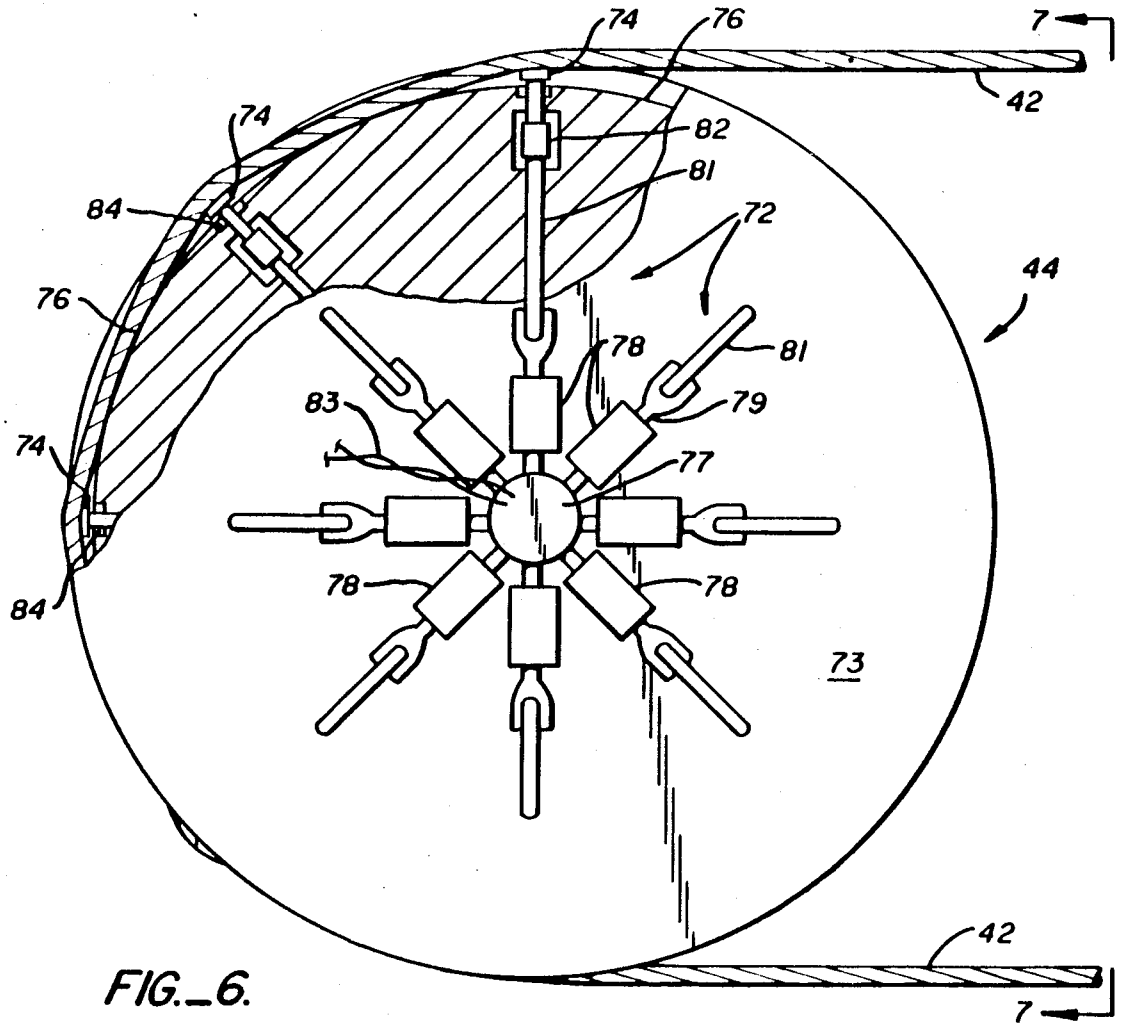
FIG. 6 is an enlarged, side elevational view, partially broken away, of a bull wheel assembly constructed in accordance with the present invention.

Synchronism is achieved in tramway system 21 by providing a bull wheel assembly, such as assembly 44 shown in detail in FIGS. 6 and 7. Bull wheel 44 includes adjustment means, generally designated 72, mounted to the body 73 of the bull wheel and formed to effect a change in the radius at which haul rope 42 is supported on the bull wheel during driving of the haul rope.

Most preferably, a change in the radius of bull wheel 44 is accomplished by providing a plurality of radially movable members, such as pegs or pusher members 74 which are circumferentially spaced about the circular, peripheral drive surface or groove 76 of the bull wheel. Actuator means in the form of a motor 77 and reducer gear assemblies 78 are coupled by link members 79 and 81 and by flexible coupling 82 to the pegs or pusher elements 74. Motor 77 can be an electric motor coupled by conductors 83 to a controller 84 (FIG. 1).

Controller 84 provides control signals to motor 77 so as to actuate the motor and radially displace pegs 74 with respect to the wheel hub and drive shaft 91. Such movement of pegs 74 increases or decreases the effective radius of the bull wheel. Since the haul rope may not extend 180 degrees around wheel 44, the expression "radius" has been used instead of diameter. It is preferably that all of pegs 74 be displaced simultaneously to the same extent so that in FIG. 6 the diameter at which the rope is supported also is increased.

Pegs 74 can be seen to be retractable into recesses 84 so that the cable or rope can bear against the nominal diameter 76 of the bull wheel. In the preferred form of operation, pegs 74 extend slightly above surface 76 so that actuator motor 77 can be used to either raise or lower the pegs from a neutral position or nominal radius, depending upon feedback which will be described in more detail hereinafter.

As will be understood, other actuator assemblies for control of the radial position of pegs 74 can be provided. One such system, for example, might include friction wheels carried by the bull wheel and oriented in the same plane as the bull wheel. A drive shoe can be selectively engaged with the friction wheels on one side of the axis thereof to raise the pegs and on the other side of the axis to lower pegs 74. A suitable lever system can provide the necessary mechanical advantage between the friction wheel and the pegs.

In order to further insure synchronism of driving, it is preferable that each pair of drive bull wheels are mounted to a common drive or are mechanically coupled to operate at the same speed. In the illustrated embodiment all four drive bull wheels have the same diameter and are mounted to a single common drive shaft 91 which is driven by motor or prime mover assembly 95. Driving all four bull wheels at the bottom of the assembly also has been found to be particularly advantageous. All four wheels 38, 39, 45 and 46 can be driven by a common drive shaft, or more typically, by two drive shafts with each drive shaft during two bull wheels. Another typical alternative installation would be to employ a common drive shaft and drive bull wheels at the bottom of the uphill course 22 and a common drive shaft and drive bull wheels at the top of downhill course 23. In any event, the driving pair of bull wheels in tramway 21 most preferably are mechanically coupled to operate at the same speed, for example, by mounting to a common drive shaft.

Dynamic adjustment of the bull wheel diameter so as to maintain synchronism between parallel haul ropes is accomplished by providing sensing means 94 positioned proximate each haul rope and formed to sense the presence of carrier units 24. More particularly, sensing means 94 is preferably formed to sense the location of grip assembly 36 along the haul rope. Sensor means 94 can include an arm 96 that trips a switch to trigger a timing signal which is communicated through conductors 97 to controller 84. The controller can then compare the time at which each grip assembly reaches the respective sensors. If the cabin is skewed as a result of advancement of one of the haul ropes faster than the other, controller 84 will respond to the sensed signals to adjust pegs 74 so as to reduce or increase the effective bull wheel radius in an amount which will correct the skewing resulting from small errors in the bull wheel radius.

It is only necessary for one bull wheel in a pair to include adjustment means 72. Thus, drive bull wheel 33 can be provided with adjustment means 72 while the other bull wheel 34 need not include an adjustment assembly. Since bull wheels 33 and 44 will constantly operate to adjust the effective drive radius of the haul ropes, the corresponding idler bull wheels 38 and 46 should be mounted on slip collars or sleeves 98 and 99 on idler shafts 101 and 101*a*. This allows the idler wheels 38 and 46 to accommodate adjustments made by adjustable drive bull wheels 33 and 44.

Drive shafts 101 and 101*a* can be a common idler shaft only if all of the idler wheels are rotatable independently of each other, e.g., by mounting them on slip collars on the common idler shaft. If not independently adjustable, the idler wheels fixed to a common shaft will fight each other due to friction differences in the system.

As will be appreciated, sensors 94 can also take the form of photoelectric cells or magnetic sensors, and they can be positioned at one or more locations along the haul rope courses, usually supported from a tower which carries the support sheaves for the haul ropes. Controller 84 can take the form of a digital computer, and the adjustment assembly 72 can employ pneumatic or hydraulic actuators to effect radial displacement of the adjustment pegs. Additionally, instead of employing a plurality of pegs or pusher elements, circumferentially extending sections of the bull wheel defining groove 76 can be hinged at one point and free to be displaced outwardly at another point to effect radial displacement of the haul rope. Other radial displacement structures and actuators are suitable for use with the method and apparatus of the present invention.

In its broadest form the method of the present invention will be understood to be comprised of a method for varying the rate of advancement of a haul rope without changing the rate of rotation of the bull wheel on which it is mounted. This method is accomplished by rotating the bull wheel, and while it is rotating, changing the radius at which the haul rope is supported by the bull wheel. When pairs of side-by-side ropes are employed, whether horizontally or vertically oriented, the method enables synchronism to be achieved when feedback from sensors are employed to cause radial adjustment of one of the bull wheels.

In tramway system 21, driving of all four drive bull wheels 33, 34, 43, 44 by common drive shaft 91 results in all wheels turning in the same direction, as indicated by arrows 106. If idler wheels 39 and 45 turn in the same direction, as shown by arrows 107, and if first pair 22 of haul ropes move in one direction and second pair 23 move in an opposite direction, one pair of haul ropes is advantageously supported in a figure-eight or crossed-line configuration proximate the bull wheels. As can be seen from FIG. 5, haul ropes 41 and 42 are crossed proximate opposite ends so that the direction of reversal can be accomplished with all bull wheels rotating in the same direction and with the driving side of the haul ropes being elevated or above most of the return side.

The return side of the haul ropes is most advantageously used to compensate for slack in the line and establish rope tension. Thus, a tensioning sheave 108 is provided in each of the haul rope return sides and can have a tensioning weight attached thereto. Crossing of downhill haul ropes to position the return side below the driving side facilitates the mounting of such a tensioning means to the haul ropes.

It should be noted that the drive bull wheels can be positioned at either the top or the bottom of the system shown in the drawing. Thus, bull wheels 45 and 46 can be drive bull wheels at the bottom of the return course while bull wheels 33 and 34 are provided as drive bull wheels. It is also possible to have all of the bull wheels 38, 39, 45 and 46 as drive bull wheels, particularly when counterweight 108 is employed in the lines. The location of the drive bull wheels at the top or the bottom of an inclined tramway assembly, or at either end of a horizontal assembly, is not regarded as a novel portion of the present tramway system.

What is claimed:

1. In an aerial tramway haul rope drive assembly including at least one bull wheel mounted for rotation and having a circular peripheral drive surface, and a haul rope mounted on and extending around a portion of said drive surface, said haul rope extending from said bull wheel to haul rope support means supporting said haul rope for movement between said bull wheel and said support means, the improvement comprising:

means for varying the radius of said bull wheel during rotation of said bull wheel to change the rate of advancement of said haul rope without changing the rate of rotation of said bull wheel.

2. The assembly as defined in claim 1, and means for sensing the presence of a carrier unit mounted to said haul rope, said means for sensing being mounted proximate said haul rope and being coupled to said means for varying the radius of said bull wheel to communicate signals thereto as to the position of said carrier unit along said haul rope; and said means for varying the radius of said bull wheel being responsive to said signals to change the radius of said bull wheel.

3. The assembly as defined in claim 1 wherein, said assembly includes two bull wheels and two haul ropes with one of said haul ropes mounted to each of said bull wheels and extending in generally parallel relation away from said bull wheels to said support means;

carrier means coupled between said haul ropes for movement therewith;

said means for varying said radius of said bull wheel being provided at one of said bull wheels; and means for sensing the positions of coupling of said carrier means to both of said haul ropes, and said means for sensing communicating control signals to said means for varying the radius of said bull wheel based upon the sensed relative positions of the coupling of said carrier means to said haul rope.

4. The assembly as defined in claim 3 wherein, said bull wheels are mounted for rotation in substantially vertical planes.

5. The assembly as defined in claim 3 wherein, said carrier means is detachably coupled to both of said haul ropes by grip means, and said means for sensing the positions of coupling of said carrier means to both of said haul ropes senses the presence of said grip means along said haul ropes.

6. The assembly as defined in claim 3 wherein, said bull wheels are mechanically coupled for driving at the same speed.

7. The assembly as defined in claim 1 wherein, said assembly includes a pair of drive bull wheels at a first station, a pair of idler bull wheels at a second station, a pair of haul ropes extending in substantially parallel relation between the drive bull wheels and said idler bull wheels, and carrier means demountably attached to both of said haul ropes for movement therewith.

8. The assembly as defined in claim 7 wherein, said drive bull wheels and said idler bull wheels are mounted for rotation in substantially vertically oriented planes.

9. The assembly as defined in claim 8 wherein, said drive bull wheels are mounted to a common drive axle, and the one of said idler bull wheels having the haul rope carried by said drive bull wheel having said means for varying the bull wheel radius is mounted for rotation independently of the rate of rotation of the other of said idler bull wheels.

10. The assembly as defined in claim 9, and a second aerial tramway haul rope assembly including the elements as defined for the first-named assembly;

said second assembly further extending over a course substantially parallel to the course of said first-named assembly; and means for transferring said carrier means between said first-named assembly and said second assembly at said first station and at said second station.

11. In a bull wheel assembly for an aerial tramway, said bull wheel assembly including two side-by-side bull wheels each having a wheel body with central hub means and a substantially circular peripheral drive surface formed to support and frictionally drive a haul rope at a radius from said hub, the improvement comprising:

adjustment means mounted to a wheel body of one of said bull wheels and formed for displacement of the haul rope supported theron to effect a change in said radius at which said haul rope is supported to synchronize advancement of the haul ropes without changing the relative rates of rotation of said bull wheels.

12. The bull wheel assembly as defined in claim 11, and sensing means formed to sense the location of an aerial tramway grip assembly along one of the haul ropes, said sensing means generating a signal indicating said grip assembly has reached said sensing means; and said adjustment means being coupled to and responsive to signals from said sensing means to displace one of said haul ropes radially.

13. In an aerial tramway system having a first pair of endless-loop haul ropes extending over a first course, carrier means coupled between said first pair of haul ropes for transport thereby, a first pair of drive bull wheels, and a first pair of idler bull wheels, said first pair of haul ropes mounted to said first bull wheels and distended therebetween; and a second pair of endless-loop haul ropes, extending over a second course carrier means coupled between said second pair of haul ropes for transport thereby, a second pair of drive bull wheels, a second pair of idler bull wheels, said second pair of haul ropes mounted to said second bull wheels and distended therebetween, the improvement comprising:

the first pair of drive bull wheels and second pair of drive bull wheels and said first pair of idler bull wheels and said second pair of idler bull wheels all being oriented to rotate in a substantially vertical plane for driving of said haul ropes in vertical planes;

said carrier means being mounted to said first pair of haul ropes and to said second pair of haul ropes for detachment therefrom proximate opposite ends of the courses;

transfer path defining means extending between adjacent opposite ends of said first course and said second course for transfer of detached carrier means from said first pair of haul ropes to said second pair of haul ropes at one end of said courses and from said second pair of haul ropes to said first pair of haul ropes at an opposite end of said courses; and attachment means proximate said opposite ends of said first course and said second course for coupling detached carrier means to said pairs of haul ropes.

14. The aerial tramway system as defined in claim 3, wherein, said first pair of drive bull wheels are mounted for driving of said first pair of haul ropes on a common shaft.

15. The aerial tramway system as defined in claim 14, wherein, all of said drive bull wheels are mounted for rotation in the same direction on a common drive shaft; and one pair of said first and second pairs of haul ropes is mounted to the drive and idler bull wheels with a crossed configuration forming a figure-eight proximate each end of said haul ropes to reverse the direction of driving of carrier means.

16. The aerial tramway system as defined in claim 13, wherein, at least one drive bull wheel of said first pair of drive bull wheels having means for adjusting the radius on which one of said first pair of haul ropes is supported.

17. The aerial tramway system as defined in claim 16 wherein, said means for adjusting is formed to adjust the radius of said drive bull wheel during driving of said haul rope; and an idler bull wheel, corresponding to said drive bull wheel having said means for adjusting mounted thereto, is mounted for rotation independently of the other idler bull wheel in said first pair of bull wheels.

18. A method of synchronizing the relative rates of advancement of a pair of haul ropes driven by a pair of bull wheels comprising the steps of:

a. rotating said bull wheels at rates of rotation which remain fixed relative to each other; and b. synchronizing the relative rates of advancement of said haul ropes by changing the radius at which at least one of said pair of aerial tramway haul ropes is supported on at least one of said bull wheels.

19. A method of maintaining synchronism between the rate of advancement of a pair of haul ropes being driven by a pair of bull wheels comprising the steps of:

a. rotating said bull wheels the same rate of rotation; and b. during said rotating step, changing the radius at which one of said haul ropes is supported on one of said bull wheels while maintaining the same rate of rotation of said bull wheels.

20. The method as defined in claim 19, and the steps of:

sensing the positions of haul rope grip assemblies mounted on each of said haul ropes; and based upon the sensed positions, changing said radius to maintain the same relative relationship of said grip assemblies.

* * * * *